US006295918B1

(12) United States Patent
Simmons et al.

(10) Patent No.: US 6,295,918 B1
(45) Date of Patent: Oct. 2, 2001

(54) SUSPENDED DIAPHRAGM

(76) Inventors: John M. Simmons, 605 Slayton; Tom M. Simmons, 504 Slayton, both of Saginaw, MI (US) 48603

( * ) Notice: Subject to any disclaimer, the term of this patent is extended or adjusted under 35 U.S.C. 154(b) by 0 days.

(21) Appl. No.: 09/418,786

(22) Filed: Oct. 15, 1999

(51) Int. Cl.[7] ..... F01B 19/00
(52) U.S. Cl. ..... 92/98 R
(58) Field of Search ..... 92/98 R

(56) References Cited

U.S. PATENT DOCUMENTS

| | | | | |
|---|---|---|---|---|
| 2,283,439 | | 5/1942 | Herman . | |
| 2,300,722 | * | 11/1942 | Adams et al. | 92/98 R X |
| 2,339,876 | | 1/1944 | Phillips | 92/98 R |
| 2,748,797 | * | 6/1956 | Heizer et al. | 92/98 R X |
| 3,083,943 | | 4/1963 | Stewart . | |
| 3,168,907 | | 2/1965 | Mercier . | |
| 3,749,127 | | 7/1973 | Beeken . | |
| 4,175,590 | * | 11/1979 | Grandclement | 92/98 R X |
| 4,634,350 | | 1/1987 | Credle, Jr. . | |
| 4,658,585 | * | 4/1987 | Kamemoto et al. | 92/98 R X |
| 4,905,575 | * | 3/1990 | Knecht et al. | 92/98 R X |
| 5,031,875 | | 7/1991 | Zimmerman . | |
| 5,062,455 | | 11/1991 | Schurter . | |
| 5,186,615 | * | 2/1993 | Karliner | 92/98 R X |
| 5,291,822 | | 3/1994 | Alsobrooks . | |
| 5,535,987 | | 7/1996 | Wlodarczyk . | |
| 5,634,391 | | 6/1997 | Eady . | |
| 5,699,717 | * | 12/1997 | Riedlinger | 92/98 R |
| 6,047,953 | * | 4/2000 | Jacob, Jr. | 92/98 R X |

* cited by examiner

*Primary Examiner*—John E. Ryznic
(74) *Attorney, Agent, or Firm*—Michael D. McCully

(57) ABSTRACT

A diaphragm (10) for a fluid pump, accumulator, pressure regulator, or similar device comprises two major components: (1) a central body portion (12) having a first degree of flexibility; and (2) a peripheral portion (14) having a second degree of flexibility that is less than that of the central body portion. In one embodiment, this lesser degree of flexibility is effected by forming the peripheral portion (14) of the diaphragm into a material thickness that is greater than that of the central body portion (12). In another embodiment, the lesser degree of flexibility of the peripheral portion (14) is effected by forming the peripheral portion from a material that is dissimilar to that of the central body portion (12), the peripheral portion material having a degree of flexibility that is less than that of the central body portion. In each of the embodiments, the peripheral portion (14) extends into the interior of the fluid device housing (20, 22) a prescribed amount beyond the lateral inside surfaces of the two mating fluid device housing sections that combine to mount the suspended diaphragm (10). Because of the fact that the peripheral portion (14) extends a certain distance into the interior of the fluid device housing, the point of flexure (actually a circle of flexure) (24) of the diaphragm is located interiorly of the fluid device housing such that the circle of flexure does not contact the inside surface of the fluid device housing during operation.

11 Claims, 7 Drawing Sheets

SUSPENDED DIAPHRAGM

BACKGROUND OF THE INVENTION

1. Field of the Invention

The present invention relates to a diaphragm for use in a fluid pump, accumulator, pressure regulator, or similar device wherein the diaphragm separates one fluid from another, and functions to equalize the fluid pressures within the device on each side of the diaphragm.

2. Description of the Prior Art

Fluid pumps of the reciprocating type are generally driven by another fluid, usually compressed air. These reciprocating fluid pumps utilize opposing pairs of pistons, bellows, diaphragms, etc. that separate the pumping fluid (i.e., compressed air) from the pumped fluid (e.g., water, acids, chemicals, potable liquids, etc.). In these reciprocating-type pumps, compressed air is alternately applied to commonly the outside surface of one diaphragm, then the outside surface of the opposite diaphragm in order to shift both diaphragms back and forth. The pumped fluid enters and exits the fluid pump at the opposite sides of each diaphragm (the insides) in response to the reciprocal action of each diaphragm to first, draw pump fluid into the fluid pump body, then exhaust the pumped fluid from the fluid pump body. Typical of the diaphragms utilized in such reciprocating pumps are shown in U.S. Pat. Nos. 4,634,350, 3,749,127, and 5,634,391.

An accumulator, sometimes referred to as a pressure regulator, generally comprises a hollow closed pressure vessel with a flexible diaphragm therein that divides the interior of the hollow pressure vessel into two separate cavities. One of the cavities is commonly filled with compressed air in a manner to exert pressure on the flexible diaphragm, thereby exerting this pressure on the fluid to be regulated which is contained in the other cavity of the accumulator on the oppose side of the diaphragm. Typical diaphragms as used in accumulators/pressure regulators are shown in U.S. Pat. Nos. 5,062,455, 2,339,876, 3,168,907, 2,300,722, 5,291,822, and 3,083,943.

As illustrated in all of the above-mentioned patents, the diaphragms generally comprise a central portion and a periphery portion that is commonly fitted between opposing mating metal shells that define the fluid pump housing or body, pressure regulator body, or accumulator pressure vessel. In fluid pumps, commonly the central portions of the diaphragms are more rigid, and are attached to oppose ends of a pump shifting rod. In such cases, the diaphragms flex in an annular area between the central, more rigid portion of the diaphragm and the periphery portion of the diaphragm. In accumulator/pressure regulator vessels or housings, the diaphragms generally comprise a central flexible portion and a periphery portion that, as in the pump housings, is fixed between two mating metal shells of the accumulator or pressure vessel. In designs as this, the entire central portion of the diaphragm is flexible and is intended to flex within the pressure vessel during normal use.

As these various prior art diaphragms flex and reciprocate within their respective housings, stress points occur at the corner edges of the device housings. These corner edges are indicated in FIGS. 1 and 2 by the numeral 2. FIGS. 1 and 2 are sections of prior art devices using conventional designs of diaphragms.

Those skilled in the art will appreciate that continued flexure of the diaphragms at the stress points of the diaphragms adjacent the device housing corner edges 2 will result in premature fatigue and failure of the diaphragms at these locations. It can also be appreciated that typical diaphragms are circular in configuration, and therefore, that the fatigue points in the diaphragms adjacent the device housing corner edges are not true "points", but rather, take the form of circles having diameters slightly less than the inside diameter of the device housing.

FIGS. 3 and 4 are figures similar to FIGS. 1 and 2, respectively, that illustrate attempts made to lessen the stress at the stress points (stress circles) of typical flexible diaphragms used in these various environments. Typically, as shown in FIG. 3, the corner edges of the device housing that clamp onto the diaphragm periphery are beveled at various angles (45° being common) in order to eliminate the sharp circular edge of the device housing, and permit the diaphragm to flex at a larger radius of curvature at its flex point (flex circle), thereby significantly reducing stress at the specific diaphragm stress circles.

FIG. 4 illustrates another design for eliminating the sharp corner edges of the device housing, specifically forming these edges with rounded surfaces 6. These rounded surfaces, although more expensive to machine or form, totally eliminate the sharp edge surfaces by making a rounded transition from one surface to its mating 90° surface, without the introduction of two corner edges in the 45° beveled transition surface of the edge shown in FIG. 3.

In some instances, these design changes shown in FIGS. 3 and 4 were effective in reducing the instances of diaphragm failure at the specific stress circles adjacent the diaphragm periphery where it mounts to the device housing. In other instances, these designs actually created additional problems that: (1) affected the integrity of the system wherein the specific device (fluid pump, pressure regulator, etc.) was utilized; and (2) essentially only postponed the deterioration and failure of the particular diaphragms at their stress circles. This situation is illustrated in FIGS. 3 and 4. Specifically, in the instances wherein the diaphragm is used with a reciprocating fluid pump, when the pumped fluid is a solvent, acid, cleaner, or other liquid that is susceptible to solidification, solidified particles of the pumped liquid, dissolved or suspended contaminants, etc. tend to collect in the area of little or no fluid movement, specifically in the area adjacent the diaphragm/device housing mounting. This area is identified as numeral 8 in FIG. 4.

Those skilled in the art will readily appreciate that as these solidified particles or contaminants build up in the indicated area 8, two negative situations can occur. The first is that the build-up of these solidified particles can accumulate and grow to the point of effectively filling in the material that was cut away by the 45° bevel 4 or curved surface 6, to the degree that the accumulation of solidified particles causes the deterioration and failure of the diaphragm at the stress circles, in a manner essentially identical to the process that occurs in the designs shown in FIGS. 1 and 2. Secondly, repeated oscillating contact of the diaphragm against this build-up of solidified particulate matter from the pumped fluid can also cause the build-up of particulate matter to break free from the build up in relatively large solid particles, which are then pumped with the fluid for its particular application. In certain applications, these relatively large free solid matter particles are detrimental to the peculiar process involved, and also contribute to premature deterioration and failure of delicate fluid seals in the fluid pump and other mechanisms downstream that come in contact with the fluid.

OBJECTS OF THE INVENTION

It is therefore an object of the present invention to provide a diaphragm for a fluid pump, accumulator, pressure regulator, or similar device that is not susceptible to failure in the area adjacent its attachment mounting to the fluid device housing.

It is a further object of the present invention to provide such a diaphragm that incorporates an enlarged peripheral portion that provides the mounting of the diaphragm to and between opposing mating surfaces of the fluid device housing.

It is a still further object of the present invention to provide such a diaphragm wherein the peripheral portion extends into the interior of the fluid device sufficiently to prevent the central body portion of the diaphragm from contacting the fluid device interior adjacent the peripheral portion.

SUMMARY OF THE INVENTION

A diaphragm (10) for a fluid pump, accumulator, pressure regulator, or similar device comprises two major components:

(1) A central body portion (12) having a first degree of flexibility; and (2) A peripheral portion (14) having a second degree of flexibility that is less than that of the central body portion. In one embodiment, this lesser degree of flexibility is effected by forming the peripheral portion (14) of the diaphragm into a material thickness that is greater than that of the central body portion (12). In another embodiment, the lesser degree of flexibility of the peripheral portion (14) is effected by forming the peripheral portion from a material that is dissimilar to that of the central body portion (12), the peripheral portion material having a degree of flexibility that is less than that of the central body portion.

In each of the embodiments, the peripheral portion (14) extends into the interior of the fluid device housing (20, 22) a prescribed amount beyond the lateral inside surfaces of the two mating fluid device housing sections that combine to mount the suspended diaphragm (10). Because of the fact that the peripheral portion (14) extends a certain distance into the interior of the fluid device housing, the point of flexure (actually a circle of flexure) (24) of the diaphragm is located interiorly of the fluid device housing such that the circle of flexure does not contact the inside surface of the fluid device housing during operation.

DETAILED DESCRIPTION OF THE INVENTION

Figure 1:
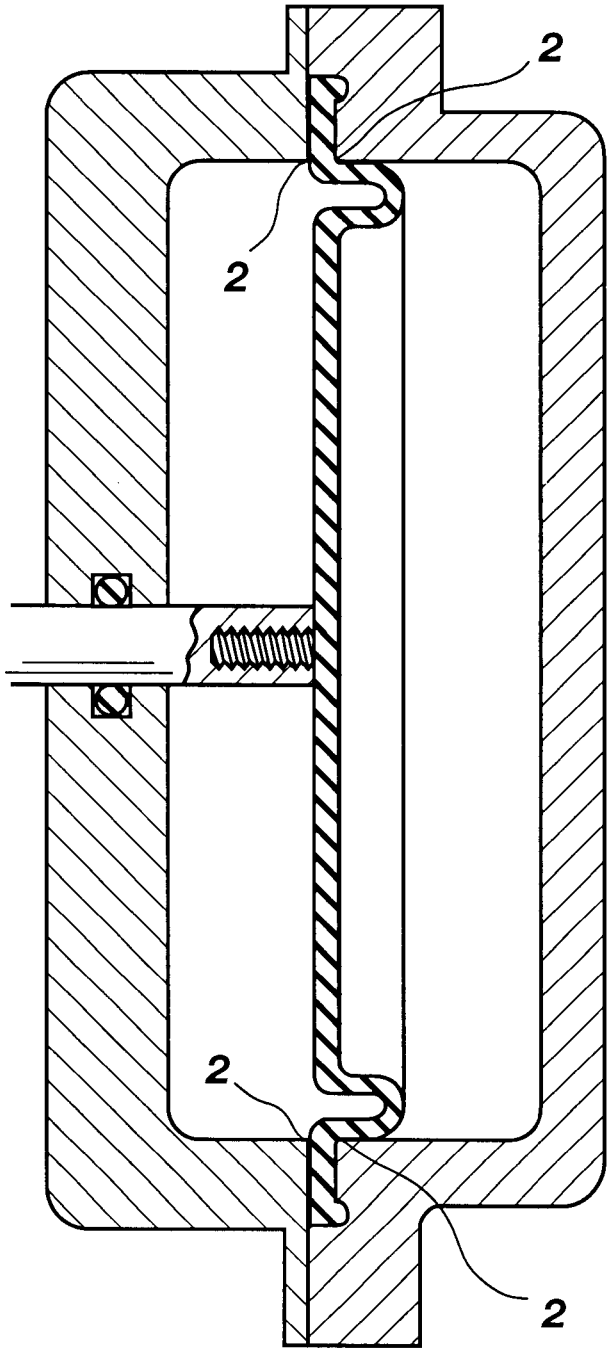
Fig. 1 (PRIOR ART)
FIG. 1 is a sectional view through one of the pumping chambers of a typical prior art reciprocating diaphragm fluid pump illustrating a common design of attachment of the diaphragm to the fluid pump housing.
Figure 2:
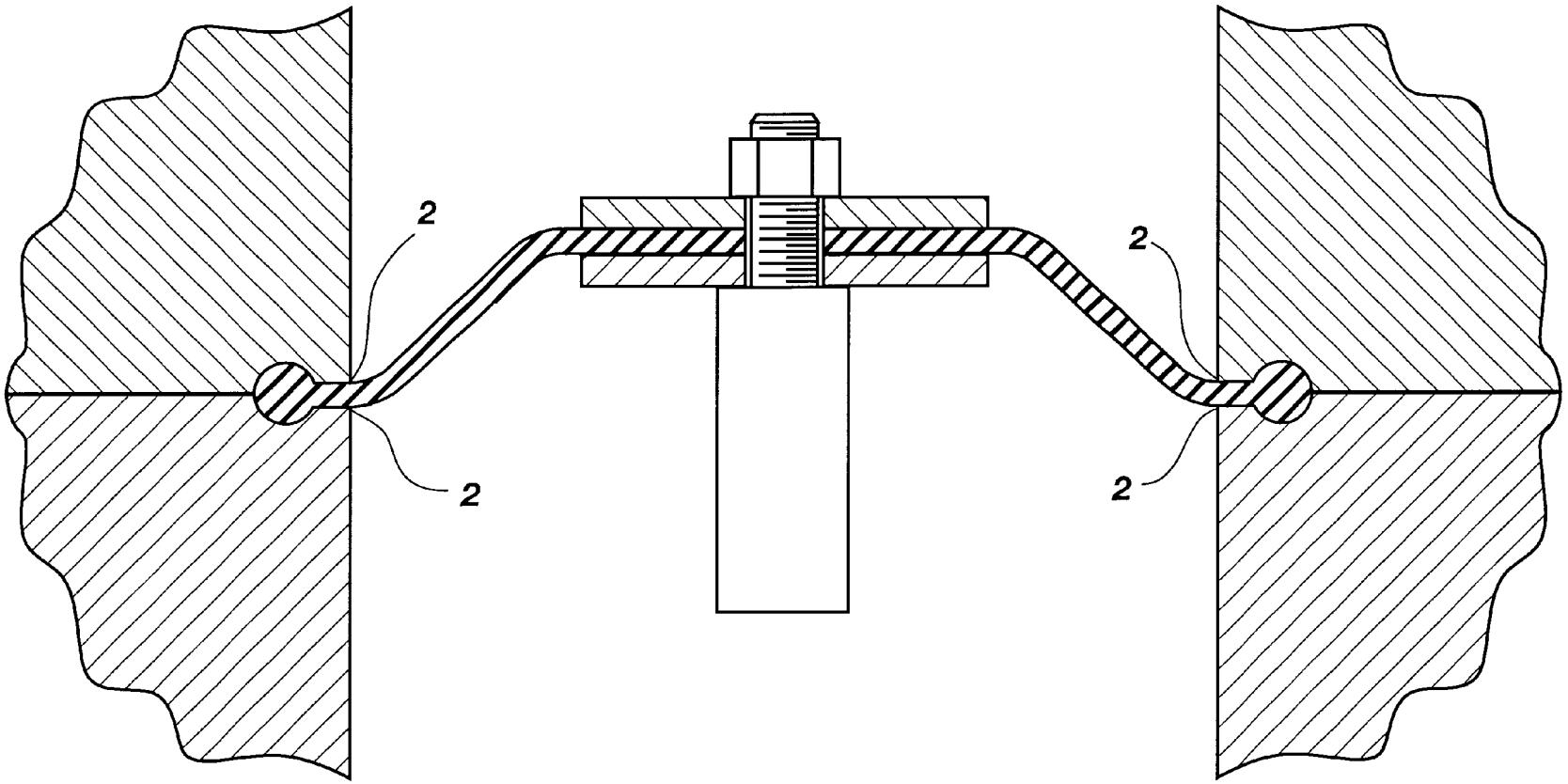
Fig. 2 (PRIOR ART)
FIG. 2 is a partial sectional view through another prior art fluid device (fluid pump, pressure regulator, etc.) illustrating a second common design of mounting a diaphragm within such a device.
Figure 3:
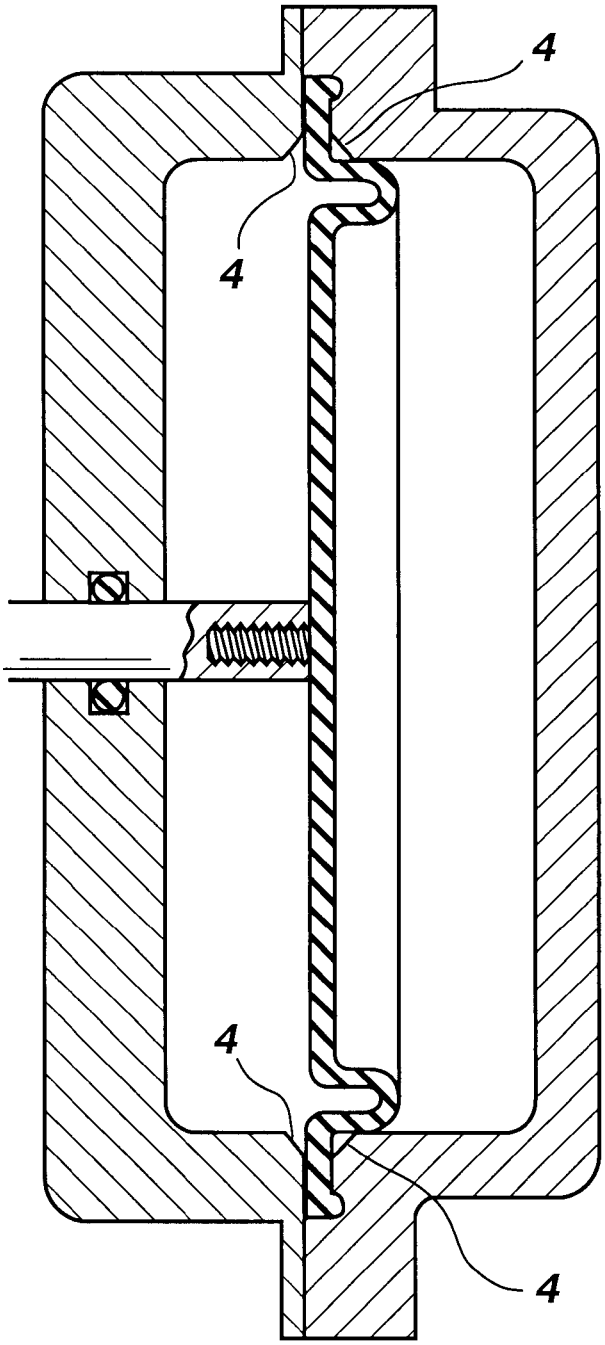
Fig. 3 (PRIOR ART)
FIG. 3 is a view similar to FIG. 1, illustrating the prior art 45° beveled design to the mating fluid housing sections.
Figure 4:
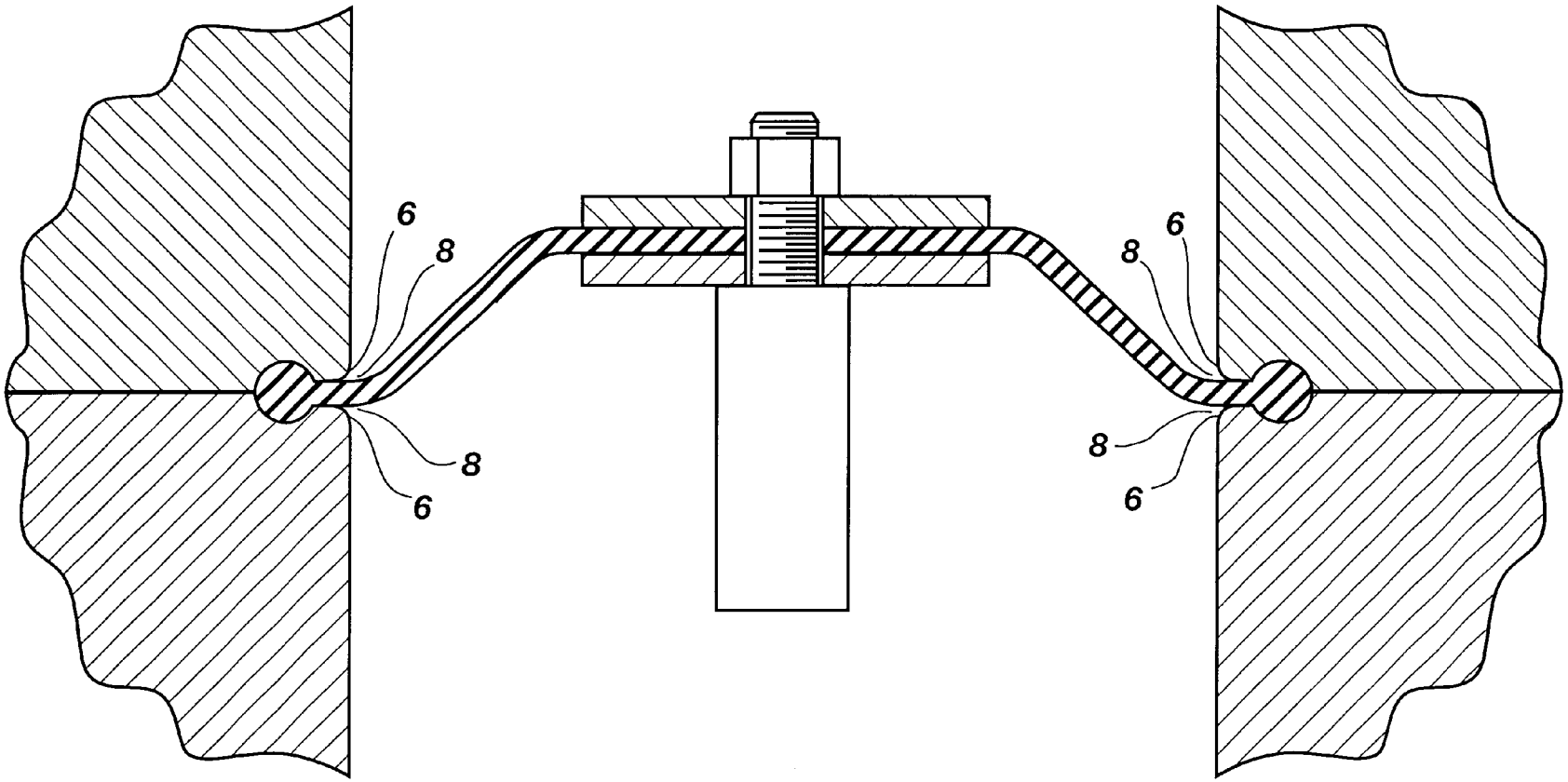
Fig. 4 (PRIOR ART)
FIG. 4 is a view similar to FIG. 2, illustrating the prior art curved design to the mating fluid housing sections.
Figure 5:
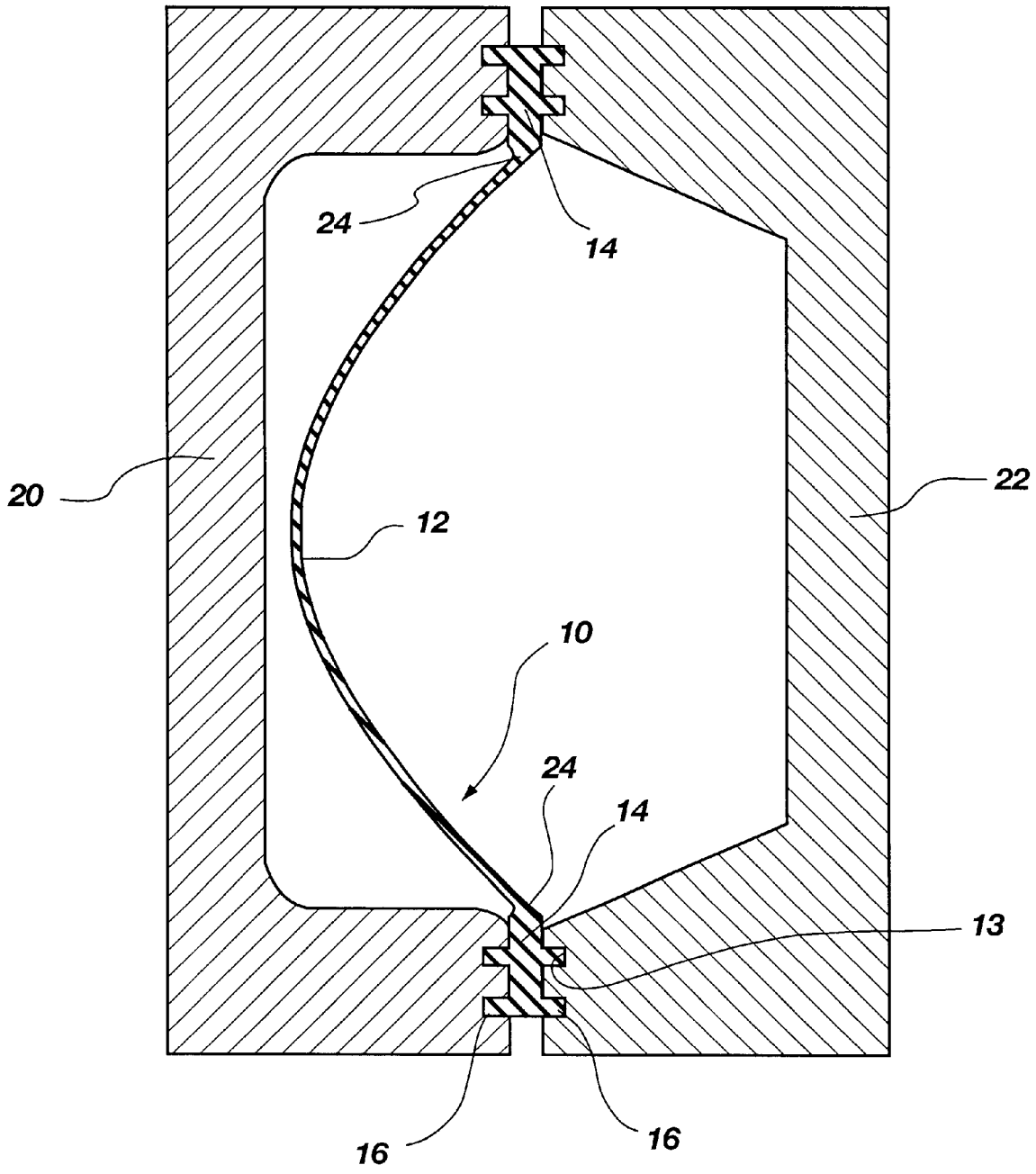
FIG. 5 is a conceptual drawing of the design concept of the diaphragm of the present invention illustrating the diaphragm being suspended by the enlarged diaphragm peripheral section within the fluid device cavity formed by the two mating fluid device sections.

The problems of the prior art designs in diaphragms for fluid pumps, accumulators, pressure regulators, and similar devices having been explained in somewhat detail in the Prior Art section of this document, the reader's attention is directed to FIG. 5, which is a schematic illustration of the concept of the suspended diaphragm of the present invention, generally illustrated at 10. For purposes of explanation, FIG. 5 is a sectional view through the diameter of a circular suspended diaphragm. As in conventional diaphragms of this nature, the suspended diaphragm 10 of the present invention comprises a central body portion 12 and a peripheral portion 14. The central portion 12 is commonly of uniform thickness and exhibits a first degree of flexibility in accordance with its particular application. The suspended diaphragm 10 of the present invention, however, incorporates the peripheral portion 14 being of a somewhat greater thickness than that of the central body portion 12 for various purposes. Understandably, one of these purposes is to enable the peripheral portion 14 to be formed with one or more laterally extending beads 16 that are designed to fit in mating annular recesses or seats 18 formed in the fluid device housing sections 20 and 22. Those skilled in the art will appreciate that the lateral beads 16 are, in fact, annular in order to fit in the fluid device housing section annular recesses 18.

The suspended diaphragm of the present invention accomplishes its objectives and overcomes problems of prior art designs by having the peripheral portion 14 thereof extend a significant distance into the interior of the fluid device defined by the two housing sections 20 and 22. Those skilled in the art will appreciate that, by extending the peripheral portion 14 into the fluid device housing interior, the primary point of flexure of the diaphragm, generally illustrated at 24, is at the juncture of the central body portion 12 and the peripheral portion 14, and extends into the fluid device housing sufficiently away from the edge surfaces of the fluid device housing sections 20 and 22 so that the suspended diaphragm flexes at a point (actually at a circle) that is remote from the mating edges of the fluid device housing sections. In this regard, it should be pointed out that, as a general rule, the diaphragm peripheral portion 14 does not flex or bend as the diaphragm central body portion oscillates within the device body.

FIG. 5 also illustrates that the suspended diaphragm 10 of the present invention can be used with any conceivable design of the mating corner edges of the device housing sections, and that these various designs have literally no influence on operation or function of the suspended diaphragm. This is because the peripheral portion 14 of the suspended diaphragm is considerably thicker than the central body portion, and because of the fact that the peripheral portion is fitted into a channel or groove defined by the mating surfaces of the two fluid device housing sections, and is there retained in essentially static position. More importantly, however, because of the fact that the peripheral portion 14 extends a certain distance into the interior of the fluid device, and therefore away from the corner edges of the device housing sections, the point (circle) of flexure 24 of the suspended diaphragm does not come in contact with the corner edges of the device housing sections, and therefore is not put under the additional stress of device housing section sharp corner edges or the buildup of solidified particles of the pumped fluid in the general area of the device housing section corner edges, as has been previously described in the Prior Art section.

Figure 6:
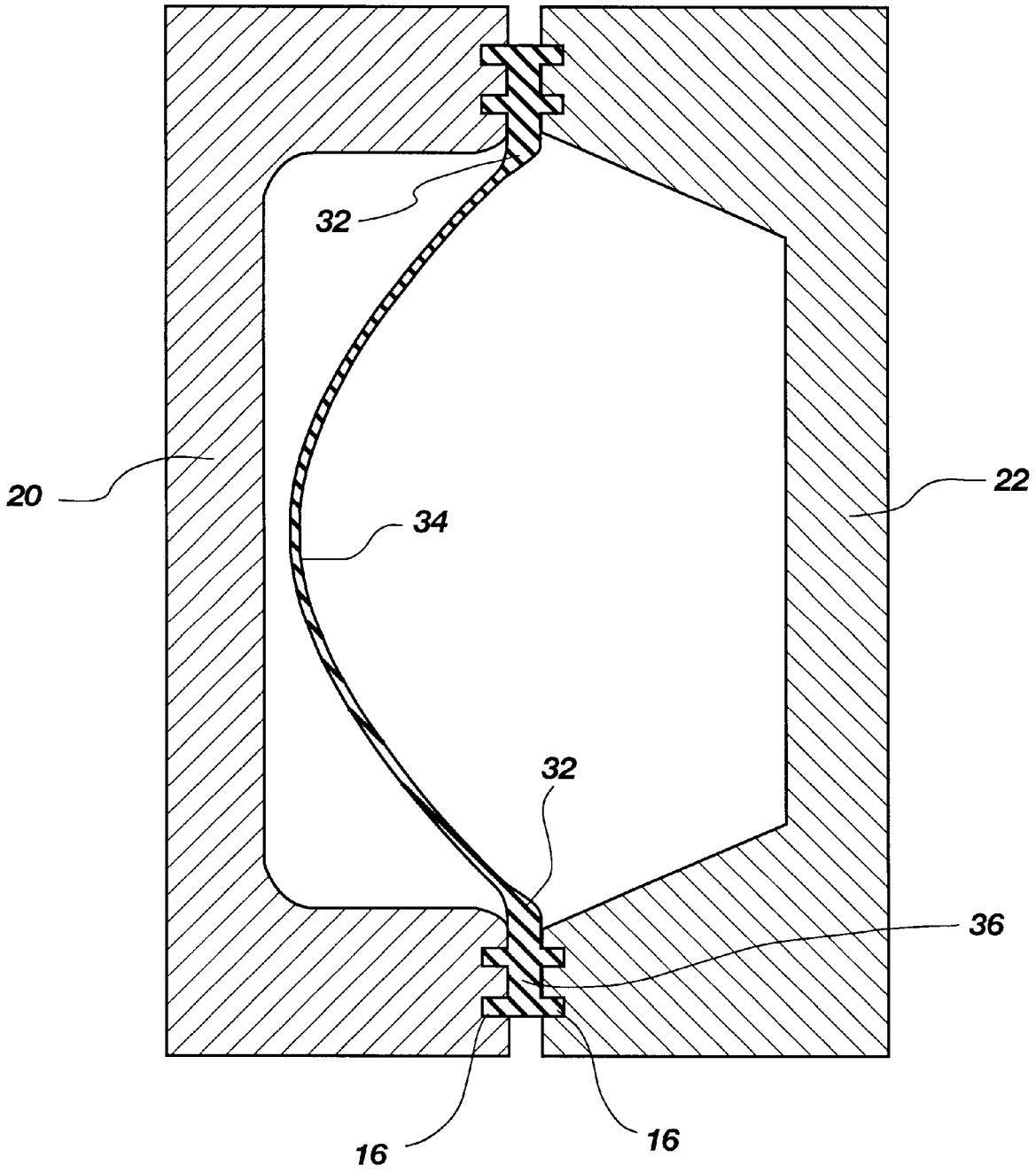
FIG. 6 is a conceptual drawing similar to FIG. 5, illustrating a second embodiment of the suspended diaphragm of the present invention.

FIG. 6 shows a second embodiment of the suspended diaphragm 30 of the present invention. The difference between this embodiment 30 and the embodiment shown in FIG. 5 is the design of the point (circle) of flexure 32 at the juncture or union of the central body portion 34 and the peripheral portion 36 of the suspended diaphragm. Specifically, whereas the first embodiment shown in FIG. 5 shows a more-or-less sharp transition from the greater thickness of the peripheral portion 14 to the lesser thickness of the central body portion 12, the second embodiment shown in FIG. 6 shows a more gradual transition from the greater thickness of the peripheral portion 36 to the central body portion 34. Those skilled in the art will readily appreciate that this design has the effect of increasing the size of the point (circle) of flexure 32 of this second embodiment suspended diaphragm over a larger annular area of the diaphragm, thereby increasing the durability, and therefore the life, of the suspended diaphragm.

Figure 7:
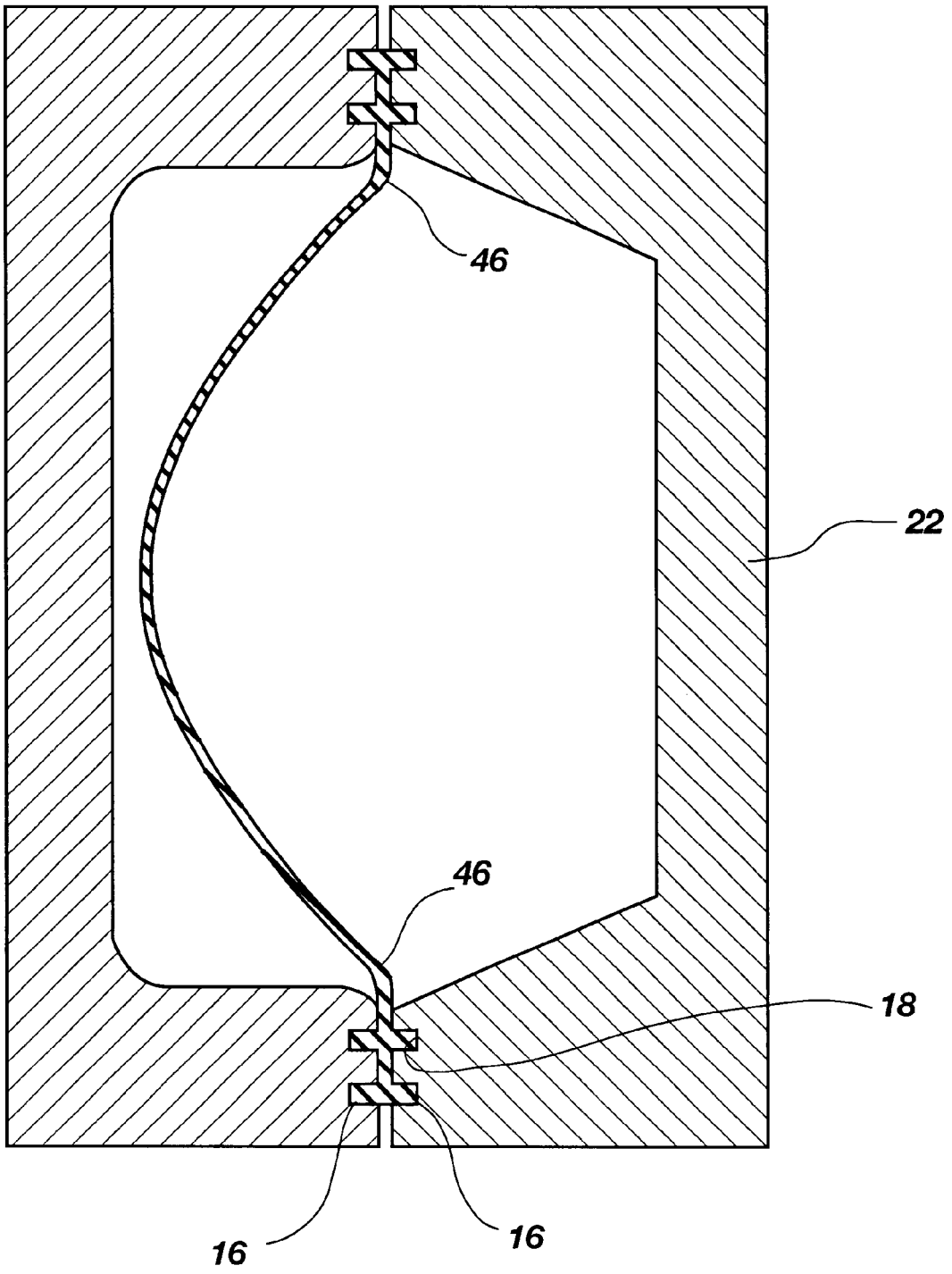
FIG. 7 is a conceptual drawing similar to FIGS. 5 and 6, illustrating a third embodiment of the suspended diaphragm of the present invention.

FIG. 7 shows a third embodiment of the suspended diaphragm 40 of the present invention. As the first two embodiments of the suspended diaphragm shown in FIGS. 5 and 6 incorporate a peripheral portion 14, 34 having a greater thickness than that of the central body portion 12, 36, the third embodiment 40 incorporates a central body portion 42 and a peripheral portion 44 that are essentially identical in thickness, but are constructed of dissimilar materials. Specifically, the peripheral portion 44 is constructed of a material that exhibits a degree of flexibility considerably less than that of the material of the central body portion 42. As in the first and second embodiments, the peripheral portion 44 extends into the interior of the fluid device, and because of its lower degree of flexibility, does not flex or bend as the diaphragm central portion 42 oscillates within the fluid device body. Rather, the point (circle) of flexure 46 of this third embodiment suspended diaphragm is located essentially at the union of the two dissimilar materials forming the central body portion and peripheral portion. Also, as in the first and second embodiments, the peripheral portion 44 extends a certain distance into the interior of the fluid body device sufficiently to locate this point (circle) of flexure of the diaphragm remote from the corner edges of the mating device housing sections.

Those skilled in the art will also readily appreciate that FIGS. 5, 6, and 7 are conceptual only, for the purpose of illustrating the concept of the suspended diaphragm of the present invention, specifically that of a diaphragm having a peripheral portion of a lesser degree of flexibility than that of the central body portion, and the peripheral portion extending a distance into the interior of the fluid body device sufficiently to locate the point (circle) of flexure of the diaphragm remote from the corner edges of the mating device housing sections. In the first and second embodiments, this lesser degree of flexibility of the peripheral portion is effected by forming the peripheral portion in a thickness that is greater than that of the central body portion. In the third embodiment, this lesser degree of flexibility in the peripheral portion is effected by forming the peripheral portion from a material having a degree of flexibility less than that of the diaphragm central body portion. In this regard, it will also be appreciated that the design or form of the central body portion 12, 36, may be of a uniform thickness, or may, of course, be in any known design, including and not limited to, those shown in the prior art FIGS. 1–4, and that the suspended diaphragm can be used in any fluid device wherein flexible diaphragms are used.

From the foregoing it will be seen that this invention is one well adapted to attain all of the ends and objectives herein set forth, together with other advantages which are obvious and which are inherent to the composition and method. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

LIST OF REFERENCE NUMERALS

2 prior art fluid device housing corner edges
4 prior art fluid device housing beveled edges
6 prior art fluid device housing rounded edges
8 contamination build up area
10 suspended diaphragm
12 diaphragm central body portion
14 diaphragm peripheral portion
16 diaphragm peripheral portion annular beads
18 fluid device housing section annular recess
20 fluid device housing section
22 fluid device housing section
24 diaphragm flexure point (circle)
30 second embodiment suspended diaphragm
32 diaphragm flexure circle
34 diaphragm central body portion
36 diaphragm peripheral portion
40 third embodiment suspended diaphragm
42 diaphragm central body portion
44 diaphragm peripheral portion
46 diaphragm flexure circle

What is claimed is:

1. A pressure vessel comprising:

first and second housing sections defining a pressurized interior; and a flexible pressure diaphragm positioned within the pressure vessel interior between the first and second housing sections for cyclic flexural oscillation within the pressure vessel, the pressure diaphragm comprising:

a central body section having a first degree of flexibility;

a peripheral section comprising means for supporting the central body section within the housing pressurized interior in a manner that the pressure diaphragm central body section flexes only within the housing interior, and the pressure diaphragm central body section does not contact the housing during its movement within the vessel pressurized housing.

2. A pressure vessel as set forth in claim 1, wherein the pressure diaphragm peripheral section includes locating/retaining beads for locating and retaining the pressure diaphragm in proper position.

3. A pressure vessel as set forth in claim 1, wherein the pressure diaphragm is generally planar.

4. A pressure vessel as set forth in claim 1, wherein the pressure diaphragm peripheral section extends into the pressure vessel pressurized interior generally normal to the direction of movement of the pressure diaphragm.

5. A pressure vessel as set forth in claim 1, wherein the pressure diaphragm peripheral section extends into the pressure vessel pressurized interior generally in a planar configuration relative to the pressure diaphragm central body section.

6. A pressure vessel as set forth in claim 1, wherein the pressure diaphragm is a unitary piece.

7. A pressure vessel as set forth in claim 1, wherein the pressure diaphragm is made of an elastomeric material.

8. A pressure vessel as set forth in claim 1, wherein the pressure diaphragm central body section is essentially of a uniform thickness.

9. A pressure vessel as set forth in claim 1, wherein the pressure diaphragm peripheral section is essentially of a uniform thickness.

10. A pressure vessel as set forth in claim 1, wherein the pressure diaphragm peripheral section exhibits a second degree of flexibility.

11. A pressure vessel as set forth in claim 10, wherein the second degree of flexibility is less that first degree of flexibility.

* * * * *